US008375494B2

(12) United States Patent
Hammock

(10) Patent No.: US 8,375,494 B2
(45) Date of Patent: Feb. 19, 2013

(54) CLEANING COMPOSITIONS CONTAINING A CORROSION INHIBITOR

(75) Inventor: Cory S. Hammock, Macon, GA (US)

(73) Assignee: Clean Control Corporation, Warner Robins, GA (US)

( * ) Notice: Subject to any disclaimer, the term of this patent is extended or adjusted under 35 U.S.C. 154(b) by 393 days.

(21) Appl. No.: 12/771,743

(22) Filed: Apr. 30, 2010

(65) Prior Publication Data

US 2010/0210503 A1 Aug. 19, 2010

(51) Int. Cl.
*C11D 7/60* (2006.01)
*C11D 7/00* (2006.01)
*C11D 3/00* (2006.01)

(52) U.S. Cl. ..... 8/147; 8/137; 134/34; 510/276; 510/278; 510/405; 510/434; 510/435

(58) Field of Classification Search ..... 510/278, 510/280, 291, 405, 434, 435, 108, 276; 252/384; 134/34; 8/147, 158, 137
See application file for complete search history.

(56) References Cited

U.S. PATENT DOCUMENTS 4,035,148 A 7/1977 Metzger et al.
4,203,859 A 5/1980 Kirn et al.
4,925,588 A 5/1990 Berrod et al.
5,510,047 A 4/1996 Gabriel et al.
5,514,302 A 5/1996 Brown
5,527,486 A 6/1996 De Guertechin
5,565,145 A 10/1996 Watson et al.
5,566,145 A 10/1996 Sasaki
5,643,861 A 7/1997 de Guertechin et al.
5,679,631 A 10/1997 Bohnert et al.
5,718,729 A 2/1998 Harris
5,904,735 A 5/1999 Gutierrez et al.
5,905,065 A 5/1999 Scialla et al.
5,928,384 A 7/1999 Scialla et al.
5,929,007 A 7/1999 Feng
5,962,391 A 10/1999 Oldenhove
6,019,963 A 2/2000 Kling et al.
6,171,346 B1 1/2001 Yaezell et al.
6,177,395 B1 1/2001 Silvaggi et al.
6,274,540 B1 8/2001 Scheibel et al.
6,316,399 B1 11/2001 Melikyan et al.
6,326,344 B1 12/2001 Levitt
6,340,663 B1 1/2002 Deleo et al.
6,403,547 B1 6/2002 Grippaudo et al.
6,407,048 B1 6/2002 Grippaudo et al.
6,605,579 B1 8/2003 Arvanitidou et al.
6,673,761 B2 1/2004 Mitra et al.
6,835,704 B2 12/2004 Hammock
7,005,013 B2 2/2006 Hammock
7,229,505 B2 6/2007 Hammock
2003/0215470 A1 11/2003 Wilmott et al.
2004/0184867 A1 * 9/2004 Wang et al. ..... 401/279
2008/0000503 A1 1/2008 Hammock

OTHER PUBLICATIONS

"PTL (DRAFT); Standard Test Practice for Using X-Ray Fluorescence for Evaluating Cleaning Effectiveness of Carpet Cleaning Processes", 2004.
"Standard Test Method for Accelerated Soiling of Pile Yam Floor Covering", ASTM Designation No. D 6540-00, ASTM International May 12, 2006.
"US EPA, Air Quality Criteria for Particulate Matter, EPA/600/P-99/002aF and EPA/600/P-99/002bF", http://clpub.epa.gov/ncca/cfm/partmatt.cfm Oct. 2004 , vol. 1.
"US EPA, Air Quality Criteria for Particulate Matter, EPA/600/P-99/002bF and EPA/600/P-99/002bF", http://clpub.epa.gov/ncca/cfm/partmatt.efm , vol. II.
"US EPA, Child-Specific Exposure Factors Handbook, EPA-600-P-00-002B", http://oaspub.epa.gov/clmscomm.etfile?p_download_id=36528 Sep. 2002.
Bakshi, et al., "Polymer-Induced Incompatibility in the Mixed Micelle Formation of Cationic Surfactants with Bulky Polar Head Groups", Journal of Surfactants and Detergents Jul. 2001 , vol. 4, No. 3, pp. 297-302.
Bakshi, "Surfactant-Polymer Interactions", Journal of Surfactants and Detergents Jan. 2001 , vol. 4. No. 1.
Gauthire-Lafaye, et al., "Polymers in Detergency", AOCS 4th World Congress on Detergents, Thodia, Courbevoie, France 1998.
Goddard, et al., "Interactions of Surfactants with Plymers and Proteins", CRC Press, Boca Raton, FL 1993.
Kwak, "Polymer-Surfactant Systems", Marcel Dekker, New York 1998.
Nagarajan, "Polymer-Surfactant Interactions", AOCS Presentation, Pennsylvania State University 2001.
Napper, "Polymer Stabilization Colloidal Dispersions", Colloid Science 1983.
Sporik, et al., "Mite, Cat and Cockroach Exposure, Allergen Sensitization, and Asthma in Children: A Case-Control Study of Three Schools, Thorax", 1999 , vol. 54, pp. 675-680.
Ray et al., Physicochemical Studies on the Interfacial and Bulk Behaviors of Sodium *N*-Dodecanoyl Sarcosinate (SDDS), Journal of Surfactants and Detergents, 2009, vol. 12, pp. 131-143.
Hamposyl N-Acyl Sarcosinate Surfactants, Product Information, Chattern Chemicals, Inc., Chattanooga, Tennessee.

*Primary Examiner* — Alexander Markoff
(74) *Attorney, Agent, or Firm* — Kilpatrick Townsend & Stockton LLP

(57) ABSTRACT

Cleaning compositions containing a corrosion inhibitor are provided for removing soil from carpets, upholstery and the like without subjecting common metal alloys used in aircraft and other constructions to corrosive attack. Cleaning compositions include at least one dispersing agent, at least one anti-redeposition agent, at least one corrosion inhibitor, at least one pH modifier, at least one chelating agent and at least one stabilizing agent. The compositions also optionally include at least one fragrance and/or at least one preservative agent. Methods for making and using the cleaning compositions are also described.

21 Claims, No Drawings

CLEANING COMPOSITIONS CONTAINING A CORROSION INHIBITOR

TECHNICAL FIELD

The present invention relates to the field of cleaning compositions and to processes for utilizing such compositions to clean carpets, upholstery and other fiber surfaces. More particularly, the present invention is directed to cleaning compositions containing a corrosion inhibitor for use in removing soil and stains from carpets, upholstery and the like—particularly where these surfaces are in contact with or in close proximity to metal surfaces. The present invention is also directed to preventing redeposition of soil and stains on such surfaces and to processes for cleaning such soiled and/or stained surfaces utilizing cleaning compositions containing a corrosion inhibitor.

BACKGROUND OF THE INVENTION

U.S. Pat. Nos. 6,835,704, 7,005,013 and 7,229,505, describe surfactant-free cleaning compositions for use in removing soil and stains from fiber surfaces such as carpets, upholstery and the like as well as for preventing redeposition of soil and stains on such surfaces. Additionally, these patents describe processes for cleaning such soiled and/or stained fiber surfaces utilizing aqueous forms of such surfactant-free cleaning compositions having a surface tension of greater than about 38 dynes per centimeter (cm).

While the surfactant-free compositions described in these patents provide excellent cleaning performance, the corrosion properties of these compositions are less than desirable, particularly when these compositions are contacted with or in close proximity to metal surfaces, for example when used on carpets or upholstery in aircraft or other similar applications. It would therefore be desirable to provide a cleaning composition with improved corrosion inhibition properties that does not significantly reduce its cleaning efficiency.

SUMMARY OF THE INVENTION

Compositions of the present invention provide improved corrosion resistance over compositions described in U.S. Pat. Nos. 6,835,704, 7,005,013 and 7,229,505, particularly when these compositions are contacted with or in close proximity to metal surfaces, for example when used on carpets or upholstery in aircraft, trains, buses, boats or in other similar applications. Improved corrosion resistance is achieved by incorporating a corrosion inhibitor to the compositions described in U.S. Pat. Nos. 6,835,704, 7,005,013 and 7,229,505. Embodiments of the present invention thus relate to a cleaning composition suitable for use on surfaces that contact or are proximate to a metal surface prone to corrosion.

One embodiment of the invention is a cleaning composition suitable for use on fibers or surfaces that contact or are proximate to a metal surface prone to corrosion. The composition includes at least one dispersing agent; at least one anti-redeposition agent; at least one corrosion inhibitor; at least one pH modifier; at least one chelating agent; and at least one stabilizing agent.

Corrosion inhibitors suitable for the compositions described herein include compositions which will impede the corrosion process of metals in contact with or, in close proximity to, the fiber or surface to be treated with the composition. Cleaning compositions containing the corrosion inhibitor also, however, have a desirable surface tension, preferably above 38 dynes per cm, so that the composition will not cause undesirable wetting of the fiber or surface to be treated and thus lower its cleaning efficiency.

In one embodiment, the corrosion inhibitor is sodium lauroyl sarcosinate.

In another embodiment, the composition further includes at least one of a fragrance or a preservative agent.

In yet another embodiment, the composition includes, in weight percentages per total weight of the composition, 0.01-10.0% dispersing agent; 0.001-5.0% anti-redeposition agent; 0.001-10% corrosion inhibitor; sufficient pH modifier to adjust the pH of the composition to a pH of about 5 to about 12; 0.01-10.0% chelating agent; 0.0-2.0% fragrance; 0.05-25.0% stabilizing agent; sufficient amount of at least one preservative agent; and sufficient water to adjust the weight percent of the aqueous composition to 100%.

The composition, in aqueous form, preferably has a surface tension greater than about 38 dynes per cm.

The dispersing agent according to one embodiment of the invention includes one or more of polymeric or co-polymeric compounds of polyacrylic acid, polyacrylic acid/maleic acid copolymers, styrene/maleic anhydride copolymers, polymethacrylic acid and polyaspartic acid. In one embodiment, the dispersing agent is polyacrylic acid.

The anti-redeposition agent according to another embodiment includes one or more of polymeric or co-polymeric compounds of polyvinylpyrrolidone, polyvinylbetaine, polyvinyl pyrrolidone/vinylacetate copolymers, polyvinylpyrrolidone/dimethylamino-ethylmethacrylate copolymers, polyvinylpyrrolidone/acrylic acid copolymers, polymethylvinylether/maleic anhydride copolymers, and polyvinylpyridine-n-oxide. In one embodiment, the anti-redeposition agent is polyvinylpyrrolidone.

The chelating agent according to yet another embodiment includes one or more of ethylenediaminetetraacetic acid, diethylenediaminepentaacetic acid, nitrilotriacetic acid, hydroxyethylenediaminetriacetic acid, iminodisuccinic acid, aminotrismethylenephosphonic acid, hexamethylenediamine-tetramethylenephosphonic acid, and diethylenetriaminepentamethylene-phosphonic acid. In one embodiment, the chelating agent is iminodisuccinic acid.

The fragrance according to one embodiment includes one or more of monocyclic terpenes, dicyclic terpenes, acyclic terpenes, oxygenated terpene derivatives, and oxygenated aromatic derivatives. In one embodiment, the fragrance is a terpene.

In one embodiment, the pH modifier is added in a sufficient amount to maintain a pH range of about 8.5 to about 10 in the composition.

In another embodiment, the stabilizing agent includes one or more of alcohols, glycol ethers, and glycol ether esters of glycols. In one embodiment, the stabilizing agent is ethyl alcohol.

In yet another embodiment, the preservative agent is includes one or more of 1,3-dihydroxymethyl-5-5-dimethylhydantoin, 1,2-benzisothiazolin-3-one, 5-chloro-2-methyl-4-isothiazolin-3-one, 2-methyl-4-isothiazolin-3-one, 3-iodo-2-propynyl butyl carbamate, phenoxyethanol, 2-bromo-2-nitropropane-1,3-diol, methyl paraben, propyl paraben, isopropyl paraben, butyl paraben, isobutyl paraben, diazolidinyl urea and hydroxymethylglycinate. In one embodiment, the preservative agent is 1,2-benzisothiazolin-3-one.

In another embodiment, a method includes contacting a fiber or surface with a composition having a surface tension of at least greater than about 38 dynes per cm. The composition includes: at least one dispersing agent; at least one anti-redeposition agent; at least one corrosion inhibitor; at least one pH modifier; at least one chelating agent; and at least one stabilizing agent.

In one embodiment, the fiber or surface is in contact with or proximate a metal that is susceptible to corrosion. In yet another embodiment, the fiber or surface is in an aircraft cabin or other construction where the fiber or surface is in contact with, or in close proximity to, a metallic surface.

DETAILED DESCRIPTION OF THE INVENTION

Studies on the surfactant-free carpet cleaning compositions described in U.S. Pat. Nos. 6,835,704, 7,005,013 and 7,229,505 revealed that the corrosion properties of these compositions are less than desirable, particularly when these compositions are contacted with or in close proximity to metal surfaces, for example when used on carpets or upholstery in aircraft or other similar applications. It has been discovered that further compositional changes could result in a composition having reduced metal corrosion properties, while at the same time maintaining the improved soil removal properties as compared to prior-art surfactant-based carpet and upholstery cleaners.

Evaluation of the corrosive properties of surfactant-free and prior-art surfactant-based cleaners utilizing ASTM F 483-98 ((Reapproved 2002) Standard Test Method for Total Immersion Corrosion Test for Aircraft Maintenance Chemicals) and ASTM F 1110-02 (Standard Test Method for Sandwich Corrosion Test) indicated that the absence of an anionic surfactant from these cleaners was the reason for the undesirable corrosion properties of these cleaners. However, while anionic surfactants (such as sodium dodecyl sulfate) present in prior-art surfactant-based cleaners reduced the corrosivity of aircraft maintenance chemicals used for carpet and upholstery cleaning, the anionic surfactant reduced the efficiency of the cleaner to disperse and remove soiling from indoor carpeting and upholstery.

Accordingly, a corrosion inhibitor was added to the compositions described in U.S. Pat. Nos. 6,835,704, 7,005,013 and 7,229,505. Embodiments of the present invention thus relate to a cleaning composition suitable for use on surfaces that contact or are proximate to a metal surface prone to corrosion. The composition includes at least one dispersing agent; at least one anti-redeposition agent; at least one corrosion inhibitor; at least one pH modifier; at least one chelating agent; and at least one stabilizing agent.

The compositions of the present invention are effective for removing particulates from fibers, surfaces comprising fibers, and other surfaces. The compositions are particularly effective when the fibers, surfaces comprising fibers and other surfaces are in contact with, or close proximity to, metals in which corrosion could be a concern. Such metals include, but are not limited to, iron, steel, aluminum, magnesium, copper, cadmium, zinc, nickel, chromium, titanium, and alloys thereof, and are commonly used in aircraft and other motor vehicle constructions, including but not limited to boats, trains, buses and automobiles.

While the compositions of the present invention described herein are particularly suitable in applications where metal corrosion is a concern, it will be understood that the compositions of the present invention can be used in general cleaning applications in which metal is not in contact with or proximate to the fiber or surface to be cleaned.

Methods of the present invention comprise treatments for fibers, materials comprising fibers, surfaces comprising fibers, and/or other surfaces. As used herein fibers or surfaces means fibers, materials made from fibers, materials comprising some amount of fibers, woven and nonwoven materials, upholstery fabrics, rugs, carpeting, padding, mats, drapery fabrics, table linens, and materials made of fibers and fabrics, such as those found in interior environments. Fibers and surfaces also includes surfaces of materials that are not made of fibers that are found in indoor or interior environments for which preventing redeposition of particulate matter is useful, including but not limited to, flooring, furniture surfaces, countertops, walls, trim and other surfaces found in indoor environments. Treatment of fibers and surfaces may comprise removal of particulate material from a portion or the entire length of the fiber, from the surface of the fiber, from a padding material adjacent to a fiber-containing material, and from smooth and rough surfaces. Fibers may be natural or synthetic fibers, and includes combinations and mixtures of natural and synthetic fibers, and combinations and mixtures of one or more natural or one or more synthetic fibers. Natural fibers include, but are not limited to, silk, wool, cotton, mohair, cashmere, linen, flax fibers, ramie, hemp, jute, sisal, kapok, and other fibers made by or derived from animals, plants, insects and other living organisms. Synthetic fibers include, but are not limited to, various polyesters, nylons, rayon, arnel, cellulose, acetates, acrylic, modacrylic, olefin, vinyon, saran, metallic fibers, spandex, aramids, polybenzimidazole (PBI), sulfar, and other synthetic materials that can be made into fibers. Surfaces comprising fibers include, but are not limited to, carpets of all types, sizes, and uses, such as area rugs or wall-to-wall carpeting, felts, and fabrics used in indoor or outdoor environments, including but not limited to upholstery, linens, and drapery fabrics. Surfaces that do not contain fibers may also be treated with the compositions of the present invention. As is known, such fibers and surfaces may be located in interior or exterior environments, and the compositions and methods of the present invention are effective on such fibers and surfaces wherever located. An interior environment is generally considered to be indoors and an exterior environment is generally considered to be outdoors. Particular environments where the compositions and methods of the present invention are effective include interior surfaces of aircraft and other applications where contact between the metallic components therein and cleaning compositions can result in corrosion of the metallic components.

Though not wishing to be bound by any particular belief, it is believed that the compositions of the present invention are effective at removal of particulate material by dispersing the particles present on a fiber or surface and lifting the particle off of the fiber or surface, holding the particle in the liquid portion of the composition, referred to herein as dispersing the particle, preventing the particle from reassociating with the fiber or surface by remaining in the liquid, and being removed from the area by removing some amount of the liquid portion of the composition. By combining dispersing, dissolution and anti-redeposition of charged and other particles without wetting the fiber or surface, and the associated soil spreading problems, the present invention overcomes problems which have been encountered with previously known cleaning compositions. For example in carpet applications, previously known cleaning compositions overcome stain prevention chemicals present on the carpet fibers and allow water to penetrate into the fiber, and allow water to penetrate further down the length of the fibers towards, and into the padding of the carpet. The soil or dyes are carried into the fiber, down the fiber or into the padding by the water, which then stains the fibers of the carpet or requires higher pressure removal techniques to withdraw the penetrated water and soil or dyes. The present invention comprises compositions and processes for removal of soils from fibers and surfaces and reduces the human and animal exposure to such soils and other particulates commonly found in indoor environments.

The compositions and methods of the present invention are effective in removing particulates from surfaces and are particularly effective in indoor or interior environments where particulate matter is present in high amounts. For example, indoor environments where persons smoke, fires are used for heating or cooking, during periods of high pollen count or dust count, or high traffic areas where humans, animals and others track soil and other particulate matter into the interior environment on a regular or frequent level. For example, many commercial and industrial locations where there is frequent traffic can be treated with the present invention, including, but not limited to, all means of public transportation, airplanes, trains, subway trains, taxis, buses, cars, malls, concert halls, public buildings, bars, hotels, motels, condominiums, apartments, day care facilities, elderly facilities, meeting halls, cinemas, theaters, physician offices, hospitals, kennels, and veterinary hospitals, and other areas where humans, animals or other carriers of soils, particulate matter, or smoke walk, ride or repose. Methods of the present invention comprise applying the compositions of the present invention to surfaces, including fibers and materials comprising fibers, present in interior environments having high amounts of particulate matter, and removing the composition after an amount of the particulate matter has admixed with the composition. Such applications may occur one or multiple times and determining the number of applications is dependent on the amount of particulate matter present and the degree of removal desired.

Methods of the present invention comprise applying the compositions of the present invention to fibers, materials comprising fibers, and other surfaces using fabric cleaning devices and methods such as home, industrial or truck mounted carpet cleaning machines, hand cleaning methods, upholstery cleaning machines, steam or fluid applicators, mops, and combined with removal mechanisms such as vacuum or suction, removing particulate material from the fibers or other surfaces.

Methods of the present invention comprise applying a liquid composition to a fiber, allowing sufficient time for the particulate matter, including particles and dyes, to disperse within the composition, and removing the composition from the fiber. By applying, it is meant that the composition contacts the fiber. Other associated materials may also be contacted by the composition, such as backing material, pads, or materials to which the fibers may be attached or interwoven. By the particulate matter dispersing within the composition, it is meant that the particulate matter including but not limited to, particles and dyes, are more associated with the composition and less associated with the fiber or surface. The particulate matter may or may not dissolve in the liquid composition and may be admixed in the liquid or with components of the composition. Before applying the composition the particulate matter is found associated with the fiber, and after applying the composition, the particulate matter is found associated with the composition. The method may be repeated until the desired amount of particulate matter is removed.

Compositions of the present invention comprise aqueous cleaning compositions comprising a polymeric dispersing agent, a pH modifier, a corrosion inhibitor, and a polymeric anti-redeposition agent. The compositions may optionally further include ingredients such as chelating agents, fragrance materials, stabilizing agents, and preservative agents, and may depend on the state of the compositions, solid liquid or gel, or when the composition is admixed.

Exemplary of suitable polymeric dispersing agents for use in the compositions of the present invention are polymeric and co-polymeric compounds such as polyacrylic acid, polyacrylic acid/maleic acid copolymers, styrene/maleic anhydride copolymers, polymethacrylic acid, polyaspartic acid and the like, including combinations or mixtures of two or more of these. In one embodiment, the dispersing agent is polyacrylic acid. Water soluble compounds are useful in aqueous solutions or compounds that are sufficiently soluble at the volumes and pH of the composition.

Exemplary of suitable polymeric anti-redeposition agents for use in the compositions of the present invention are polymeric and co-polymeric compounds such as polyvinylpyrrolidone ("PVP"), polyvinylbetaine, polyvinyl pyrrolidone/vinylacetate copolymers, polyvinylpyrrolidone/dimethylamino-ethylmethacrylate copolymers, polyvinylpyrrolidone/acrylic acid copolymers, polymethylvinylether/maleic anhydride copolymers, polyvinylpyridine-n-oxide and the like which form complexes with anionic and cationic substrates and with nonionic substrates, such as household soils, dirt, stains and the like. In one embodiment, the anti-redeposition agent is polyvinylpyrrolidone. Household soil and dirt particulates may be composed of metals that do not ionize in aqueous solution including iron oxide, yttrium oxide, zinc oxide and the like. Although these particulates are non-polar, insoluble in water, and do not ionize in aqueous solution, they do contain partial negative charges at regions of the molecule (at the metal and oxygen atoms). The anti-redeposition agents of the present invention, such as PVP, generally contain a partial positive charge along the backbone of the polymer, such as $N^+$ in PVP, where an ionic bond forms resulting in dispersion in aqueous solution.

The compositions of the present invention are effective at a pH range of from about 5 to about 12, and more preferably at a pH range of from about 8.5 to about 10. pH modifying compounds, referred to herein as pH modifiers, are used to bring the pH of the composition within this pH range, and to maintain the pH within that range. pH modifiers comprise a compound capable of altering the pH of the composition to between about pH 5 and 12. An example of such a pH modifier is an alkali counter ion, in which alkali is understood to mean having base-like qualities, or is basic, and is related to $OH^-$ from the neutralization reaction of $H+OH^- \rightarrow H_2O$. The pH modifier may be the counter ion to the following ions, sodium ions ($Na^+$), potassium ions ($K^+$), calcium ions ($Ca^{+2}$), magnesium ions ($Mg^{+2}$), ammonium ($NH_4^+$) and amine ions ($NH_3^+$), for example, from ammonium hydroxide, isopropylamines, and alkanolamines), and the like. Other pH modifiers include known acids and bases, and buffering compounds useful for altering or maintaining a desired pH or pH range. In one embodiment, the pH modifier is sodium ions. The pH modifier used in the compositions should be compatible with other components of the compositions, and pass standard screening for cleaning efficacy, challenge testing and storage stability.

Suitable chelating agents include compounds such as ethylenediaminetetraacetic acid, diethylenediaminepentaacetic acid, nitrilotriacetic acid, hydroxyethylenediaminetriacetic acid, iminodisuccinic acid, aminotrismethylenephosphonic acid, hexamethylenediamine-tetramethylenephosphonic acid, diethylenetriaminepentamethylene-phosphonic acid, combinations and mixtures and the like. In one embodiment, the chelating agent is iminodisuccinic acid. Water soluble chelating agents are useful in aqueous solutions or compounds that are sufficiently soluble at the volumes and pH of the composition.

Concerning suitable fragrances or fragrance materials for use in the cleaning compositions of the present invention, it should be noted that any desirable known scents or fragrances may be employed to produce such compositions provided that the fragrance or scent passes standard screening for cleaning efficacy, challenge testing and storage stability. Moreover, the aesthetics (i.e., color, smell and the like) of a cleaning composition containing the fragrance should be suitable to users/customers. Examples of suitable fragrances or fragrance materials for use herein include, but are not limited to, terpene compounds such as monocyclic terpenes such as limonene; dicyclic terpenes such as pinene; and acyclic terpenes such as myrcene and the like. Also, oxygenated terpene derivatives such as alcohols, aldehydes, esters, ethers, ketones and the like, as well as oxygenated aromatic derivatives such as alcohols, aldehydes, esters, ethers, ketones and the like may be employed as the fragrance material in the present compositions. In one embodiment, the fragrance is a terpene.

Exemplary of terpene compounds for use herein are oils derived from citrus peels such as lemons, oranges, limes, tangerines, grapefruits and the like. Such oils are comprised of about 70-90% (by weight) terpenes (limonene, pinene, and myrcene) with smaller amounts of alcohols (terpineol, linalool, geraniol, octanol, and nonanol) and aldehydes (citral and citronellal). Examples of an oxygenated terpene derivative suitable for use as a fragrance in the compositions of this invention are oils of eucalyptus globulus, which are comprised of about 80% (by weight) terpene ether (cineol) with smaller amounts of other terpene compounds. An example of an oxygenated aromatic derivative would be oil of wintergreen, which is comprised of about 98% (by weight) aromatic ester (methyl salicylate).

Suitable stabilizing agents, which also function as fragrance stabilizing agents, include a variety of solvents including, but not limited to the following: alcohols such as methyl alcohol, ethyl alcohol, isopropyl alcohol, propyl alcohol and the like; glycol ethers (including methyl, ethyl, propyl, isopropyl, butyl, phenyl, and ethylhexyl ethers); and, glycol ether esters of glycols (such as ethylene glycol, diethylene glycol, triethylene glycol, propylene glycol, dipropylene glycol, tripropylene glycol and the like) including diethylene glycol monobutylether and diethylene glycol monobutylether acetate and mixtures thereof. In one embodiment, the stabilizing agent is ethyl alcohol.

As with fragrance materials for use herein, any desirable known preservative may be employed to produce the compositions of this invention provided that the preservative passes standard screening for challenge testing and storage stability and, furthermore, that users would be satisfied with the aesthetics (i.e., color, smell and the like) of cleaning compositions containing the preservative. Additionally, there are U.S. regulations, such as Environmental Protection Agency (EPA) directions for use, that may have to be complied with when preservatives are added to the composition. Sufficient amounts of preservatives are those that meet standard screening for challenge testing and storage stability, and may also include amounts complying with EPA directions for use. Suitable preservative agents for use in the present invention include a variety of chemical compounds with the ability to impart to chemical formulas a resistance to microbial contamination in order to assure product safety and integrity over the useful life of the product. Such preservative agents include: 1,3-dihydroxymethyl-5-5-dimethylhydantoin ("DMDM Hydantoin"); 1,2-benzisothiazolin-3-one; 5-chloro-2-methyl-4-isothiazolin-3-one; 2-methyl-4-isothiazolin-3-one; 3-iodo-2-propynyl butyl carbamate; phenoxyethanol; 2-bromo-2-nitropropane-1,3-diol; methyl paraben; propyl paraben; isopropyl paraben; butyl paraben; isobutyl paraben; diazolidinyl urea and hydroxymethylglycinate and mixtures thereof. In one embodiment, the preservative agent is 1,2-benzisothiazolin-3-one.

Corrosion inhibitors suitable for the compositions described herein include compositions which will impede the corrosion process of metals in contact with or, in close proximity to, the fiber or surface to be treated with the composition. The corrosion inhibitor should also, however, allow the composition to retain its surface tension, preferably above 38 dynes per cm, so that the composition will not cause undesirable wetting of the fiber or surface to be treated and thus lower its cleaning efficiency.

Sodium lauroyl sarcosinate has been found to be a particularly preferable corrosion inhibitor. While technically classified as a surfactant when used in known cleaning compositions, it has been discovered that when added to the cleaning compositions described in one or more of U.S. Pat. Nos. 6,835,704, 7,005,013 and 7,229,505, it does not behave as a surfactant since it allows the composition to maintain a surface tension of at least 38 dynes per cm. This unexpected property is believed to be a result of sodium lauroyl sarcosinate's amphoteric properties. When used in the cleaning compositions described herein, traditional surfactants such as sodium dodecyl sulfate have both hydrophobic and hydrophilic ends, which aggregate with each other in water to form micelles—the hydrophobic ends are attracted to each other at the "center" of the micelle and the hydrophilic ends, exposed to the water molecule, break the surface associations (hydrogen bonds) of water molecules and decrease surface tension, causing wetting and reducing the cleaning efficiency of the cleaning compositions described herein.

In contrast, while not wanting to be bound by the following statement, it is believed that when added to the cleaning compositions described herein (which have a preferred pH in the range of from about 8.5 to about 10) sodium lauroyl sarcosinate, because of its amphoteric properties, does not form micelles and does not reduce the surface tension in the cleaning composition in which it is added. Thus, while sodium lauroyl sarcosinate can generally be characterized as or classified as a surfactant, as used in the cleaning compositions of the present invention it does not have surfactant properties.

Other corrosion inhibitors suitable for use in the cleaning compositions of the present invention, which provide desirable corrosion inhibition properties but do not decrease the surface tension of the composition, include, but are not limited to: ethers of alcohols such as ethanol, 2,2'-[2-butyne-1,4-diylbis(oxy)]bis and ethynylcarbinolalkoxylate; polymers of $C_4$-$C_{14}$ alcohols such as 2-propyn-1-ol; inorganic phosphates such as sodium acid pyrophosphate, sodium hexametaphosphate, tetrapotassium pyrophosphate; inorganic salts (and esters thereof) such as boric acid; silicates (sodium or potassium salt); organic acid (and salts esters or amides thereof) such as citric acid and oleic acid; amines (and salts or amides thereof) such as monoethanolamine, diethanolamine and triethanolamine; polymers (and salts thereof) such as polycarboxylic acid and polyaspartic acid; and mixtures thereof.

Generally, in formulating aqueous cleaning compositions of the present invention, the following ranges of ingredients (as weight percentages per total weight of aqueous cleaning composition) may satisfactorily be used:

TABLE 1

| Ingredient | Operating Range | Preferred Range |
|---|---|---|
| dispersing agent | 0.01-10.0% | 0.05-1.0% |
| anti-redeposition agent | 0.001-10.0% | 0.05-1.0% |
| chelating agent | 0.01-10.0% | 0.05-1.0% |
| pH modifier | Quantity sufficient to adjust pH to about 5 to about 12 | Quantity sufficient to adjust pH to about 8.5 to about 10 |
| fragrance | 0.00-2.0% | 0.00-0.20% |
| stabilizing agent* | 0.05-25.0% | 0.10-2.0% |
| corrosion inhibitor | 0.001-10% | 0.01-0.1% |
| preservative agent | Sufficient amount | Sufficient amount |
| Water | Quantity sufficient to adjust total weight percentage to 100% | Quantity sufficient to adjust total weight percentage to 100% |

*A stabilizing agent also functions as a fragrance stabilizing agent when fragrance is present in the composition.

The ranges refer to amounts in compositions that are effective in the methods of the present invention. As explained above, these weight percentages refer to the amount of each ingredient in the overall aqueous solution "as used," i.e., as diluted as described below.

Cleaning compositions comprising the above ranges of components may be prepared from preformed concentrated stock solutions. In practice, these concentrated stock solutions are intended to be diluted with water to a desired level by an end user at the site of application of the cleaning composition depending on the particular soil extraction device or technique to be employed by the end user to treat the fiber surface. The concentrated stock solutions contain predetermined quantities (on a weight basis) of the desired ingredients so that upon dilution the resulting aqueous compositions will contain such ingredients in quantities (on a weight percent basis) corresponding to the above tabulated operating and/or preferred ranges of ingredients to be incorporated in the aqueous cleaning compositions. The concentrated stock solutions are normally diluted by a factor of from about 1:2 to about 1:256 to produce the aqueous composition for application to carpets, upholstery and other fibers and surfaces. In some embodiments, the concentrated stock solutions are diluted by a factor of from about 1:4 to about 1:128 or from about 1:16 to about 1:64.

An aspect of the present invention includes an aqueous cleaning composition having one or more polymeric dispersing agents, one or more polymeric anti-redeposition agents, one or more corrosion inhibitors and a sufficient amount of a pH modifier to maintain the pH of the aqueous composition in a range of about 5 to about 12, or about pH 8.5 to about 10.

An exemplary composition comprises the following ingredients: one or more chelating agents, such as ethylenediaminetetraacetic acid; one or more dispersing agents, such as polyacrylic acids; one or more anti-redeposition agents such as polyvinylpyrrolidone; one or more corrosion inhibitors, such as sodium lauroyl sarcosinate; a sufficient amount of pH modifiers, such as the counterions of sodium (Na), potassium (K), or ammonium, such as ammonium hydroxide ($NH_4OH$), isopropylamine or alkanolamines to maintain the pH of the composition in a range of about 5 to about 12; or in a range of about 8.5 to about 10; and one or more stabilizing agents, such as an alcohol, for example, ethanol, or glycol ethers.

Optionally, a composition may further comprise a fragrance, such as a terpene or a terpene derivative, and/or one or more preservatives, such as 1,3-dihydroxymethyl-5-5-dimethylhydantoin ("DMDM Hydantoin").

The compositions of the present invention are generally used as liquid aqueous solutions comprising at least one dispersing agent, at least one anti-redeposition agent, at least one corrosion inhibitor, at least one pH modifier, at least one chelating agent, and at least one stabilizing agent, generally in methods of cleaning fibers and surfaces. When used in liquid aqueous solutions, the ingredients of the composition are generally water soluble, or are sufficiently soluble in the volumes used or at the pH of the composition. Such compositions may further comprise other ingredients such as at least one fragrance or at least one preservative. Alternatively, the compositions of the present invention may be a dry powder that is admixed with water or other aqueous solutions to form an aqueous solution composition of the present invention. Such powders may comprise at least one dispersing agent, at least one anti-redeposition agent, at least one corrosion inhibitor, and at least one chelating agent, and may optionally comprise at least one pH modifier, at least one stabilizing agent, at least one fragrance or at least one preservative. Such powders comprise dry ingredients that may be added as one or more individual powder ingredients to form a powder composition that when added to water may have further ingredients added, such as a pH modifier or a stabilizing agent. Formulation of powder compositions are known in the art, and may further comprise additives needed for powder characteristics such as to keep the powder free flowing. Alternatively, the compositions of the present invention may also be found in paste or gel compositions comprising at least one dispersing agent, at least one anti-redeposition agent, at least one corrosion inhibitor, at least one pH modifier, and at least one chelating agent, and may further comprise at least one stabilizing agent, at least one fragrance or at least one preservative. Such paste or gel formulations are known, and additives needed for paste or gel formulations may be added to the compositions of the present invention.

The aqueous compositions of the present invention provide surface tensions of greater than about 38 dynes per cm for application onto low energy fiber surfaces, which generally have a surface tension less than about 35 dynes per cm, thereby establishing an energy barrier which is employed to maintain separation between the surface of the fiber and the cleaning composition. The formation of this energy barrier allows for the efficient transfer of particulate matter, including particles and dyes, from the surface of a fiber into an aqueous liquid phase, enables the dissolution or dispersion of charged particles, such as dirt and acid dye, polar soils, such as sugars and starches, and non-polar soils, such as oil, from the surface of the fiber into the cleaning compositions of this invention. The energy barrier formed between a fiber surface and the compositions of the present invention prevents redeposition of particulate matter and dye particles onto a fiber and facilitates adsorption of the dispersed particles into a clean cloth used to remove the unwanted soil, or transports the particulate matter away with the removal of the solution. The energy barrier also eliminates or reduces the amount of residual cleaning solution left on the fiber after completion of the cleaning task when compared to the residual amounts remaining after cleaning with traditional surfactant-containing solutions.

It should be noted that the advantages achieved by employing the higher surface tension cleaners of the present invention, while being most pronounced on fibers with a soil-repellant finish, are also realized to a lesser degree on non-treated synthetic fibers (i.e., nylon, polyester, polypropylene and acrylic), which are intrinsically low energy surfaces and essentially non-absorbent to water based liquids.

The present invention comprises cleaning compositions having a surface tension of at least about 38 dynes per cm. In some embodiments, the composition could have a surface tension of at least about 42 dynes per cm, 46 dynes per cm, 50 dynes per cm, 54 dynes per cm, 58 dynes per cm, or 60 dynes per cm. In other embodiments, cleaning compositions may have a surface tension that ranges of from about 38 to about 60 dynes per cm, from about 38 to about 50 dynes per cm, from about 50 to about 60 dynes per cm, or above about 60 dynes per cm. Although compositions with higher surface tensions are preferred, suitable cleaning compositions have a surface tension of at least about 38 dynes per cm.

Compositions with micelle forming surfactants, which lower surface tension, are known to penetrate the typical topical hydrophobic fluorochemical soil repellant and/or stain resistant finish treatments on the fiber surface. The compositions of the present invention may be applied to a stained or soiled area employing a hand held sprayer, a pull/push applicator, a woven or non-woven fabric wipe or a similar device. The application of the compositions of the present invention to the fiber or fiber surfaces or other surfaces may be applied with any range of force to contact the composition with the fiber or surface, or to remove the composition from the fiber or surface. The amount of force used in application of composition can affect the movement of the particulate matter and dye particles. For example, in the case of certain spots and stains, forceful application of compositions may cause penetration of the stain into the fiber which causes increased potential for staining. Penetration into carpet backing causes the stain to seem to disappear, only to re-migrate to the surface during the drying stage. In instances where the compositions are applied with force to remove particulate matter, if the soil can be dispersed without being forced deeper in the carpet, the efficacy of the extraction equipment is enhanced, and there is less work needed to remove the particulate matter. If less force is used to disperse the particulate matter, less liquid reaches deeper into the fabric or carpet. If liquid containing dispersed particulate matter is forced more deeply into the fabric, it will require more force to remove that liquid, which is not an issue with extraction systems that have high force for extraction, such as truck mounted or industrial cleaners. Less forceful extraction systems, such a handheld, or home carpet or upholstery cleaning machines function at a greater efficiency using the compositions of the present invention. The handheld or home machine has lower force application, the composition is effective at dispersing the particulate matter, and the lower removal force of the hand-held or home machine can still remove the particulate matter effectively.

Methods of the present invention comprise cleaning one or more surfaces comprising fibers by applying a composition taught herein to the fibers or surfaces, which removes particulates and prevents the redeposition of the particulates, such as metal-associated soils or allergens.

The methods used in these and other methods of removing particulates from fibers and surfaces may comprise multiple applications of the compositions or multiple contacting of the fibers or surfaces, so as to remove as much of the particulates as desired. The applying or contacting steps, along with each sequential step of removing the composition, may be performed more than one time.

The compositions of the present invention may be provided in concentrated solutions that are then diluted to effective concentrations for application to the fibers or surfaces. The compositions generally comprise solutions of effective amounts of the ingredients described herein.

An exemplary method for removing allergens comprises contacting interior environment fibers or surfaces with a composition comprising, at least one dispersing agent; at least one anti-redeposition agent; at least one corrosion inhibitor; at least one pH modifier; at least one chelating agent; at least one stabilizing agent; and may further comprise at least one preservative agent; and removing a portion of the composition from the contacted interior environment fibers or surfaces after a time sufficient to disperse at least some portion of the total amount of particulate matter. Water soluble compounds are useful in aqueous solutions or compounds that are sufficiently soluble at the volumes and pH of the composition. When in an aqueous or liquid composition, the composition has a surface tension of greater than about 38 dynes per cm. The composition may further comprise at least one fragrance.

An example of such a particulate dispersing composition comprises: at least one dispersing agent; at least one anti-redeposition agent; at least one corrosion inhibitor; at least one pH modifier; at least one chelating agent; and at least one stabilizing agent. The composition may further comprise at least one preservative agent or at least one fragrance, or both. Such a particulate dispersing composition may comprise, in weight percentages per total weight of the composition: 0.01-10.0% dispersing agent; 0.001-5.0% anti-redeposition agent; 0.001-10% corrosion inhibitor; sufficient pH modifier to adjust the pH of the composition to a pH of about 5 to about 12; 0.01-10.0% chelating agent; 0.0-2.0% fragrance; 0.05-25.0 stabilizing agent; a sufficient amount of at least one preservative agent; and sufficient water to adjust the weight percent of the aqueous composition to 100%.

It must be noted that, as used in this specification and the appended claims, the singular forms "a," "an," and "the" include plural referents unless the context clearly dictates otherwise.

It should be understood, of course, that the foregoing relates only to exemplary embodiments of the present invention and that numerous modifications or alterations may be made therein without departing from the spirit and the scope of the invention as set forth in this disclosure.

The present invention is further illustrated by way of the examples contained herein, which are provided for clarity of understanding. The exemplary embodiments should not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

For purposes of comparison, a 1200 gram (g) sample of a surfactant-free aqueous cleaning composition according to U.S. Pat. Nos. 6,835,704, 7,005,013 and 7,229,505 was prepared by blending, in laboratory scale apparatus, the following ingredients:

TABLE 2

| Ingredients | Weight Percent (%) | Grams (g) |
|---|---|---|
| Water (Tap/40 ppm $CaCO_3$) | 80.776 | 969.312 |
| Sodium iminodisuccinate (34%) | 9.800 | 117.6 |
| Polyacrylic acid, sodium salt (50%) | 2.404 | 28.848 |
| Polyvinylpyrrolidone (30%) | 6.670 | 80.04 |
| DMDM Hydantoin | 0.0500 | 0.6 |
| Ethyl Alcohol | 0.3000 | 3.6 |
| Totals | 100.0000 | 1200.00 |

The mixing procedure employed in producing the 1200 g sample included initially weighing and incorporating 969.312 g water into a 5000 mL polypropylene beaker and then placing the beaker containing the water on a steel mixer base, inserting a Talboy agitator into the beaker and initiating agitation. Then, 117.6 g sodium iminodisuccinate, 28.848 g polyacrylic acid (sodium salt), 80.04 g polyvinylprrolidone, a preservative (1,3-dihydroxymethyl-5-5-dimethylhydantoin, "DMDM Hydantoin") and 3.6 g ethyl alcohol were incorporated, in listed order, into the water under agitation. The combined mixture was then blended for 10 minutes after which an 8-ounce (oz) portion of the 1200 g sample mixture was collected and transferred for Quality Control (QC) testing. Other portions of the mixture were collected diluted as suitable for use as Test Samples for the performance testing detailed hereinafter in Examples 3, 4 and 5.

The QC testing of the 8-ounce sample resulted in the following data:

TABLE 3

| Property | Predetermined Ranges | Test Results |
|---|---|---|
| Appearance/Odor | — | Clear, pale colored liquid with bland odor |
| pH | 8.5-9.0 | 8.75 |
| Sp. Gravity @ 25° C. | 1.035-1.045 | 1.04 |
| % Solids | 7.0-7.5% | 7.25 |
| Surface Tension | >60 dynes per cm | 63.4 |

Example 2

Sodium lauroyl sarcosinate was selected for formulation into high energy cleaners having surface tensions of greater than about 38 dynes per cm due to its unique amphiphilic properties.

A 2500 g sample of an aqueous cleaning composition in accordance with the present invention (Example 2A), along with a traditional micelle forming surfactant-based composition (Example 2B) was prepared by blending, in laboratory scale apparatus, the following ingredients:

TABLE 4

| | | Grams (g) | |
|---|---|---|---|
| Ingredients | Weight Percent (%) | Example 2A | Example 2B |
| Water (Tap/40 ppm $CaCO_3$) | 80.8500 | 2026.34 | 2026.36 |
| Sodium iminodisuccinate (34%) | 7.5500 | 189.22 | 189.20 |
| Polyacrylic acid, sodium salt (50%) | 1.8500 | 46.37 | 46.36 |
| Polyvinylpyrrolidone (30%) | 5.1500 | 129.07 | 129.05 |
| DMDM Hydantoin | 0.0500 | 1.25 | 1.25 |
| Ethyl Alcohol | 0.3000 | 7.52 | 7.54 |

TABLE 4-continued

| Ingredients | Weight Percent (%) | Grams (g) Example 2A | Example 2B |
|---|---|---|---|
| Sodium lauroyl sarcosinate (30%) | 4.0000 | 100.25 | — |
| Sodium lauryl sulfate (30%) | 4.0000 | — | 100.24 |
| Totals | 100.0000 | 2500.02 | 2500.00 |

The mixing procedure employed in producing the 2500 g sample included initially weighing and incorporating water into a 5000 mL polypropylene beaker and then placing the beaker containing the water on a steel mixer base, inserting a Talboy agitator into the beaker and initiating agitation. Then, sodium iminodisuccinate, polyacrylic acid (sodium salt), polyvinylprrolidone, a preservative (1,3-dihydroxymethyl-5-5-dimethylhydantoin, "DMDM Hydantoin"), ethyl alcohol and surfactant were incorporated, in listed order, into the water under agitation. The combined mixture was then blended for 10 minutes after which an 8-ounce portion of the 2500 g sample mixture was collected and transferred for Quality Control (QC) testing. Other portions of the mixture were collected diluted as suitable for use as Test Samples for the performance testing detailed hereinafter in Examples 3, 4 and 5.

The QC testing of the 8-ounce sample resulted in the following data:

TABLE 5

| Property | Predetermined Ranges | Test Results Example 2A | Example 2B |
|---|---|---|---|
| Appearance/Odor | Clear, pale colored liquid with bland odor | Pass | Pass |
| pH | 8.5-9.0 | 8.70 | 8.70 |
| Sp. Gravity @ 25° C. | 1.030-1.040 | 1.033 | 1.033 |
| % Solids | 6.0-6.5% | 6.15 | 6.11 |
| Surface Tension (1:16 Dilution) | >38 dynes per cm | 55.2 | 30.5 |

Since the composition of Example 2A (containing sodium lauroyl sarcosinate) maintained a surface tension of greater than about 38 dynes per cm for application onto low energy fiber surfaces (i.e., less than about 35 dynes per cm), additional testing was performed to determine if the previous soil dispersion and cleaning efficacy standards could be maintained along with improved corrosion inhibition properties for preventing corrosion of alloys used in aircraft and other constructions.

Example 3

TABLE 6

| Properties | Formula EXAMPLE 1 | EXAMPLE 2A | EXAMPLE 2B |
|---|---|---|---|
| Dilution Ratio | 1:16 | 1:16 | 1:16 |
| Surface Tension | 65.2 dyne/cm | 55.2 dyne/cm | 30.5 dyne/cm |

TABLE 6-continued

| Properties | Formula EXAMPLE 1 | EXAMPLE 2A | EXAMPLE 2B |
|---|---|---|---|
| Foaming[1] | <5 mL | 100 mL | 225 mL |
| Soil Dispersion Test (60 Minute)[2] | 3.0 | 3.0 | 0.5 |

[1]Modified Ross-Miles (5 Minute Foam)

[2]To simulate the use of the surfactant-free aqueous cleaning compositions of Example 1 to disperse common dirt and to demonstrate the improved dispersion achieved with the compositions of the present invention as compared with prior art commercial products, a 16 g test sample of an aqueous dilution (1:16) of the cleaning composition produced in Example 1 was introduced into a 22 mL KIMAX Sample Vial (Fisher Cat # 03-339-25F) along with a dirt sample comprising 0.2 g Georgia Red Clay which was obtained from a household yard and was prepared by air drying at 23° C. and 70% relative humidity and, then, grinding with a mortar and pestle. After the test sample and the control sample cleaning solutions and the dirt sample were introduced into the Sample Vials, the Sample Vials were each capped and held without shaking for 15 seconds. Then, each of the Sample Vials was inverted three times, followed by a 60 second holding period without shaking and then each of the Sample Vials was again inverted three times. Based on visual observations, the dispersion rate of the dirt in each of the tested cleaning solutions was determined and recorded after a 1 minute, a 15 minutes and a 60 minutes interval and tabulated.

The compositions containing sodium lauroyl sarcosinate (Example 2A) and sodium lauryl sulfate (Example 2B) exhibited substantially improved foam and foam stability as compared to the surfactant-free composition of Example 1. The composition of Example 2A containing the corrosion inhibitor, however, also exhibited improved surface tension as compared to the composition containing sodium lauryl sulfate (Example 2B), and did not adversely affect soil dispersion.

Example 4

A series of corrosion tests were performed to compare the corrosion inhibition capacity of sodium lauroyl sarcosinate as compared to sodium lauryl sulfate when incorporated into the cleaning compositions described in U.S. Pat. Nos. 6,835,704, 7,005,013 and 7,229,505 (the composition of Example 1).

Total Immersion Corrosion Test

TABLE 7

| Formula | Weight Loss per 1" × 2" panel Example 1 | | Example 2A | | Example 2B | |
|---|---|---|---|---|---|---|
| Alloy | Conc | 1:16 | Conc | 1:16 | Conc | 1:16 |
| Clad 2024-T3 Alclad | 300.8 | 6.1 | 6.4 | 6.7 | 8.1 | 1.1 |
| Bare 2024-T3 Aluminum MIL-C-5541 | 3.7 | 1.0 | 0.1 | 0.4 | 0.1 | 0.6 |
| Bare 2024-T3 Aluminum MIL-A-8625 Type I | 14.8 | 4.2 | 5.1 | 3.2 | 7.2 | 2.2 |
| Bare 7178-T6 Aluminum MIL-A-6625 Type I | 18.4 | 1.6 | 1.7 | 0.9 | 2.8 | 0.6 |

The average weight change of each test specimen shall not exceed ±10 mg in a 24 hour immersion period when tested in accordance with ASTM F 483-98 (Reapproved 2002) Standard Test Method for Total Immersion Corrosion Test for Aircraft Maintenance Chemicals.

Sandwich Corrosion Test

TABLE 8

| Formula | Weight Loss per 1" × 2" panel | | | | | | |
|---|---|---|---|---|---|---|---|
| | Example 1 | | Example 2A | | Example 2B | | Control |
| Alloy | Conc | 1:16 | Conc | 1:16 | Conc | 1:16 | Water |
| Bare 7075-T6 Aluminum Mil-A-8625 Type I | 3 | 1 | 1 | 0 | 0 | 0 | 1 |

Corrosion in excess of that on the control panel constitutes failure when tested in accordance with ASTM F 1110-02 Standard Test Method for Sandwich Corrosion Test.
Appearance/Corrosion:
0 - No visible corrosion and no discoloration present
1 - Very slight corrosion or discoloration, and/or up to 5% of area[A] corroded
2 - Discoloration and/or up to 10% of area[A] corroded
3 - Discoloration and/or up to 25% of area[A] corroded
4 - Discoloration and/or more than 25% of area[A] corroded, and/or pitting present
[A] "Area" refers to area under the filter paper, or if no filter paper is used, the area where the test material was applied.

As shown in Tables 7 and 8, the composition containing sodium lauroyl sarcosinate (Example 2A) exhibited substantially improved corrosion resistance properties as compared to the surfactant-free composition of Example 1, and the corrosion resistance of this composition was comparable to that of the composition containing sodium lauryl sulfate (Example 2B).

Example 5

Cleaning efficacy data for the compositions of Examples 1, 2A and 2B were obtained by X-ray fluorescence (XRF) in accordance with the "PTL (DRAFT)—Standard Test Practice Using X-Ray Fluorescence for Evaluating Cleaning Effectiveness of Carpet Cleaning Processes (2004)." The test soil in this test included a standard set of compounds containing elements suitable for XRF detection, chosen for particle size, hardness and surface characteristics of naturally occurring soils commonly found in household carpet soil (such as clay and sand).

TABLE 9

| Test Soil Characteristics | | |
|---|---|---|
| Compound | Particle Size | Comments |
| Iron Oxide | <1 μm | Commonly found in soil |
| Zinc Oxide | <74 μm | Clay-like consistency |
| Yttrium Oxide | <10 μm | Sand-like characteristics |
| Zirconium Boride | <44 μm | Black dust-like characteristics |

The test soil was first applied to Zytel™ 01FNC010 nylon pellets, which were used to transfer the test soil to carpet test specimens following ASTM D6540. The carpet test specimens (untreated[1] or precleaned[2]) were mounted securely inside a rotating drum with the pile surface exposed and subjected to an accelerated soiling process. The degree of soiling (a) was assessed by XRF analysis to determine the starting concentration of each compound. The carpet test specimens were pre-sprayed (1 gallon solution per 200 $ft^2$). After 15 minutes, the samples were cleaned by two extraction strokes and two dry strokes starting at the bottom of the sample on the first stroke at 1.0 foot per second for a total of four strokes. The carpet test specimens were allowed to dry for 24 hours and the soil removal (b) was assessed by XRF analysis. The % soil removal was determined using the following formula:

$$\%\ \text{Soil Removal} = \frac{a-b}{}(100)$$

TABLE 10

| % Soil Removal (In-tank Commercial Truck Mount[2] Extraction) | | | | | | | | |
|---|---|---|---|---|---|---|---|---|
| | Cleaning | Process Dilutions | | Carpet | % Removal | | | |
| | Composition | Pre-Spray | Extraction | Surface | $Fe_2O_3$ | $Y_2O_3$ | ZnO | Total |
| C | Water | Water | Water | Untreated[1] | 64 | 56 | 48 | 56 |
| 1 | Example 1 | 1:16 | 1:64 | Untreated[1] | 90 | 78 | 81 | 83 |
| 2 | Example 2A | 1:16 | 1:64 | Untreated[1] | 88 | 82 | 79 | 83 |
| 3 | Example 2B | 1:16 | 1:64 | Untreated[1] | 84 | 76 | 74 | 78 |

TABLE 11

| % Soil Removal (In-tank Household[3] Extraction) | | | | | | | | |
|---|---|---|---|---|---|---|---|---|
| | Cleaning | Process Dilutions | | Carpet | % Removal | | | |
| | Composition | Pre-Spray | Extraction | Surface | $Fe_2O_3$ | $Y_2O_3$ | ZnO | Total |
| C | Water | Water | Water | Untreated[1] | 35 | 34 | 32 | 34 |
| 1 | Example 1 | 1:16 | 1:64 | Untreated[1] | 76 | 67 | 65 | 69 |
| 2 | Example 2A | 1:16 | 1:64 | Untreated[1] | 72 | 65 | 66 | 68 |
| 3 | Example 2B | 1:16 | 1:64 | Untreated[1] | 40 | 39 | 38 | 39 |

[1]Untreated Carpet Surface - Mohawk Spotlite (Style 25418-121), 25-oz/square yd, Pile 0.470" cut Nylon
[2]Commercial Truck Mount - ProChem Performer Model 980060
[3]Household Unit - Bissell Proheat Model 8910

As shown in Tables 10 and 11, the composition of Example 2A (containing the corrosion inhibitor sodium lauroyl sarcosinate) exhibited substantially better removal efficiencies than the composition of Example 2B (containing the surfactant sodium lauryl sulfate). In addition, the removal efficiencies of the composition of Example 2A were comparable to those of the composition of Example 1.

REFERENCES

Integrated Publishing; General Aviation Maintenance; Recognizing Corrosion, pp 14022_140 to 14022_145.

ASTM F 483-98 (Reapproved 2002) Standard Test Method for Total Immersion Corrosion Test for Aircraft Maintenance Chemicals.

ASTM F 1110-02 Standard Test Method for Sandwich Corrosion Test.

Chattem Chemicals, Inc.; HAMPOSYL N-Acyl Sarcosinate Surfactants; Product Information Bulletin; Surface Activity, Surface Tension and CMC.

PTL (DRAFT)—Standard Test Practice Using X-Ray Fluorescence for Evaluating Cleaning Effectiveness of Carpet Cleaning Processes (2004).

All patents, patent applications and references included herein are specifically incorporated by reference in their entireties.

We claim:

1. A cleaning composition, comprising:

a) at least one dispersing agent;

b) at least one anti-redeposition agent;

c) at least one corrosion inhibitor;

d) at least one pH modifier;

e) at least one chelating agent; and f) at least one stabilizing agent, wherein the corrosion inhibitor is sodium lauroyl sarcosinate and the composition is in aqueous form and has a surface tension greater than about 38 dynes per centimeter.

2. The composition of claim 1, further comprising at least one of a fragrance or a preservative agent.

3. The composition of claim 2, wherein the composition comprises, in weight percentages per total weight of the composition, a) 0.01-10.0% dispersing agent;

b) 0.001-5.0% anti-redeposition agent;

c) 0.001-10% corrosion inhibitor;

d) sufficient pH modifier to adjust the pH of the composition to a pH of about 5 to about 12;

e) 0.01-10.0% chelating agent;

f) 0.0-2.0% fragrance;

g) 0.05-25.0% stabilizing agent;

h) sufficient amount of at least one preservative agent; and i) sufficient water to adjust the weight percent of the aqueous composition to 100%.

4. The composition of claim 1, wherein the composition is a concentrated aqueous stock solution.

5. The composition of claim 1 wherein the dispersing agent is selected from the group consisting of polymeric or co-polymeric compounds of polyacrylic acid, polyacrylic acid/maleic acid copolymers, styrene/maleic anhydride copolymers, polymethacrylic acid, polyaspartic acid and combinations thereof.

6. The composition of claim 1 wherein the anti-redeposition agent is selected from the group consisting of polymeric or co-polymeric compounds of polyvinylpyrrolidone, polyvinylbetaine, polyvinyl pyrrolidone/vinylacetate copolymers, polyvinylpyrrolidone/dimethylamino-ethylmethacrylate copolymers, polyvinylpyrrolidone/acrylic acid copolymers, polymethylvinylether/maleic anhydride copolymers, polyvinylpyridine-n-oxide and combinations thereof.

7. The composition of claim 1 wherein the chelating agent is selected from the group consisting of ethylenediaminetetraacetic acid, diethylenediaminepentaacetic acid, nitrilotriacetic acid, hydroxyethylenediaminetriacetic acid, iminodisuccinic acid, aminotrismethylenephosphonic acid, hexamethylenediamine-tetramethylenephosphonic acid, diethylenetriaminepentamethylene-phosphonic acid and combinations thereof.

8. The composition of claim 3 wherein the fragrance is selected from the group consisting of monocyclic terpenes, dicyclic terpenes, acyclic terpenes, oxygenated terpene derivatives, oxygenated aromatic derivatives and combinations thereof.

9. The composition of claim 1 wherein the pH modifier is added in a sufficient amount to maintain a pH range of about 8.5 to about 10 in the composition.

10. The composition of claim 1, wherein the stabilizing agent is selected from the group consisting of alcohols, glycol ethers, glycol ether esters of glycols and combinations thereof.

11. The composition of claim 3 wherein the preservative agent is selected from the group consisting of 1,3-dihydroxymethyl-5-5-dimethylhydantoin, 1,2-benzisothiazolin-3-one, 5-chloro-2-methyl-4-isothiazolin-3-one, 2-methyl-4-isothiazolin-3-one, 3-iodo-2-propynyl butyl carbamate, phenoxyethanol, 2-bromo-2-nitropropane-1,3-diol, methyl paraben, propyl paraben, isopropyl paraben, butyl paraben, isobutyl paraben, diazolidinyl urea, hydroxymethylglycinate and combinations thereof.

12. A cleaning method comprising contacting a fiber or surface with a composition comprising:

a) at least one dispersing agent;

b) at least one anti-redeposition agent;

c) at least one corrosion inhibitor;

d) at least one pH modifier;

e) at least one chelating agent; and f) at least one stabilizing agent, wherein the corrosion inhibitor is sodium lauroyl sarcosinate and the composition is in aqueous form and has a surface tension greater than about 38 dynes per centimeter, and wherein the fiber or surface is in contact with or proximate a metal that is susceptible to corrosion.

13. The method of claim 12, wherein the composition further comprises at least one of a fragrance or preservative agent.

14. The method of claim 12 wherein the dispersing agent is selected from the group consisting of polymeric or co-polymeric compounds of polyacrylic acid, polyacrylic acid/maleic acid copolymers, styrene/maleic anhydride copolymers, polymethacrylic acid, polyaspartic acid and combinations thereof.

15. The method of claim 12 wherein the anti-redeposition agent is selected from the group consisting of polymeric or co-polymeric compounds of polyvinylpyrrolidone, polyvinylbetaine, polyvinyl pyrrolidone/vinylacetate copolymers, polyvinylpyrrolidone/dimethylamino-ethylmethacrylate copolymers, polyvinylpyrrolidone/acrylic acid copolymers, polymethylvinylether/maleic anhydride copolymers, polyvinylpyridine-n-oxide and combinations thereof.

16. The method of claim 12 wherein the chelating agent is selected from the group consisting of ethylenediaminetetraacetic acid, diethylenediaminepentaacetic acid, nitrilotriacetic acid, hydroxyethylenediaminetriacetic acid, iminodisuccinic acid, aminotrismethylenephosphonic acid, hexamethylenediamine-tetramethylenephosphonic acid, diethylenetriaminepentamethylene-phosphonic acid and combinations thereof.

17. The method of claim 13 wherein the fragrance is selected from the group consisting of monocyclic terpenes, dicyclic terpenes, acyclic terpenes, oxygenated terpene derivatives, oxygenated aromatic derivatives and combinations thereof.

18. The method of claim 12 wherein the pH modifier is added in a sufficient amount to maintain a pH range of about 8.5 to about 10 in the composition.

19. The method of claim 12 wherein the stabilizing agent is selected from the group consisting of alcohols, glycol ethers, glycol ether esters of glycols and combinations thereof.

20. The method of claim 13 wherein the preservative agent is selected from the group consisting of 1,3-dihydroxymethyl-5-5-dimethylhydantoin, 1,2-benzisothiazolin-3-one, 5-chloro-2-methyl-4-isothiazolin-3-one, 2-methyl-4-isothiazolin-3-one, 3-iodo-2-propynyl butyl carbamate, phenoxyethanol, 2-bromo-2-nitropropane-1,3-diol, methyl paraben, propyl paraben, isopropyl paraben, butyl paraben, isobutyl paraben, diazolidinyl urea, hydroxymethylglycinate and combinations thereof.

21. The composition of claim 3, wherein the dispersing agent is polyacrylic acid, the anti-redeposition agent is polyvinylpyrrolidone, the corrosion inhibitor is sodium lauroyl sarcosinate, the chelating agent is iminodisuccinic acid, the stabilizing agent is ethyl alcohol and the preservative agent is 1,2-benzisothiazolin-3-one.

* * * * *